US005769503A

United States Patent [19]

Stolarczyk et al.

[11] Patent Number: 5,769,503

[45] Date of Patent: Jun. 23, 1998

[54] METHOD AND APPARATUS FOR A ROTATING CUTTING DRUM OR ARM MOUNTED WITH PAIRED OPPOSITE CIRCULAR POLARITY ANTENNAS AND RESONANT MICROSTRIP PATCH TRANSCEIVER FOR MEASURING COAL, TRONA AND POTASH LAYERS FORWARD, SIDE AND AROUND A CONTINUOUS MINING MACHINE

[75] Inventors: Larry G. Stolarczyk; Gerald L. Stolarczyk, both of Raton, N. Mex.

[73] Assignee: Stolar, Inc., Raton, N. Mex.

[21] Appl. No.: 685,214

[22] Filed: Jul. 23, 1996

[51] Int. Cl.[6] ..... E21C 35/24; E21C 39/00

[52] U.S. Cl. ..... 299/1.2; 324/332

[58] Field of Search ..... 299/1.1, 1.2; 324/323, 324/332, 644

[56] References Cited

U.S. PATENT DOCUMENTS

| | | | |
|---|---|---|---|
| 3,961,307 | 6/1976 | Hochheimer et al. | 299/1.1 |
| 5,072,172 | 12/1991 | Stolarczyk et al. | 324/332 |
| 5,188,426 | 2/1993 | Stolarczyk et al. | 299/1.2 |

FOREIGN PATENT DOCUMENTS

| | | | |
|---|---|---|---|
| 2007817 | 9/1970 | Germany | 299/1.2 |
| 286910 | 11/1970 | U.S.S.R. | 299/1.1 |
| 2142063 | 1/1985 | United Kingdom | 299/1.2 |

*Primary Examiner*—David J. Bagnell
*Attorney, Agent, or Firm*—Thomas E. Schatzel; Law Offices of Thomas E. Schatzel a Prof. Corporation

[57] ABSTRACT

For use in explosive atmospheres during mining, an flame proof or explosion proof internal AC alternator is provided to source electrical power from the rotations of a cutting head. A synthetic-pulse stepped-frequency ground-penetrating radar is used with oppositely circularly polarized transmitting and receiving antennas in a phase coherent microwave transceiver to measure the thickness of a coal deposit and to control the cut of a continuous mining machine operating in an underground mine. For example, a stepped-frequency radar and resonant microstrip patch antennas mounted near the outside surface of the cutting head to obtain measurements.

16 Claims, 5 Drawing Sheets

METHOD AND APPARATUS FOR A ROTATING CUTTING DRUM OR ARM MOUNTED WITH PAIRED OPPOSITE CIRCULAR POLARITY ANTENNAS AND RESONANT MICROSTRIP PATCH TRANSCEIVER FOR MEASURING COAL, TRONA AND POTASH LAYERS FORWARD, SIDE AND AROUND A CONTINUOUS MINING MACHINE

BACKGROUND OF THE INVENTION

1. Field of the Invention

The invention relates generally to drum or arm-mounted mining instruments for measuring the thicknesses of certain valuable deposits in underground seams and specifically to synthetic pulse radar with paired opposite circular polarity transmitting and receiving antennas sensing of coal, trona and potash seam thicknesses. It further relates to such instruments with resonant microstrip patch antennas and the supplying of instrumentation power by an internal generator.

2. Description of the Prior Art

The uncut natural resources thickness can be sensor-penetrated from one side with microwave radio signals using a single resonant microstrip patch antenna. The thickness and material composition of a natural resource layer will affect the resonant frequency and impedance, or resistance, of the patch antenna. Different mineral deposits have different electrical parameters, e.g., different dielectric constants, conductivity, magnetic permeability, etc. When a patch antenna is connected to one leg of a resistance bridge network, a signal generator is used across one axis of the bridge to excite the patch antenna and a voltage is measured across the other axis of the bridge. The frequency of the signal generator is swept to find the resonant frequency and the voltage output is proportional to the resonant impedance, or resistance. These two measurements can be interpreted, for example, to determine the thickness of a layer deposit of coal in a seam in a mine. Coal is a highly nonconductive material, and usually high electrically-contrasts well with the surrounding material. Unfortunately, the change in resonant impedance, or resistance, and resonant frequency is generally limited to measuring material thicknesses of less than twelve to twenty inches. Beyond twenty inches, increases in the thickness have a measurably-useless resonant effect.

The top and bottom twelve to twenty inches of coal deposits is often undesirable for mining because such coal is contaminated. Conventional patch antennas and ground sensing equipment cannot therefore be used to sense when a coal seam cut exceeds twenty inches. To be effective uncut thickness sensors must measure thickness in real time when mounted on a cutting drum or arm. The cutting drums or arms of mining machines are rotated with mechanical means. A means for transferring electrical power from the machine to the drum or arm is difficult to do with intrinsically safe technology.

SUMMARY OF THE PRESENT INVENTION

It is therefore an object of the present invention to provide a device to measure the thickness of underground deposits from one side.

It is a further object of the present invention to provide a method for sensing the thickness of a layer deposit of coal, trona and potash.

It is another object of the present invention to provide a method for measuring the rib thickness of deposits of coal, trona and potash.

It is another object of the present invention to provide a explosion-proof and flame proof electronics package for mounting to a cutting drum or arm of a mining machine.

It is a still further object of the present invention to provide a means for electrical power generation from within a rotating explosion-proof electronics package mounted to a cutting drum or arm of a mining machine.

It is another object of the present invention to provide a means to control the cut of an underground continuous mining machine.

It is another object of the present invention to provide a radio data link from the sensor to the mining machine.

Briefly, in a preferred embodiment, a synthetic-pulse step-frequency ground-penetrating radar is used with oppositely circularly polarized transmitting and receiving antennas in a phase coherent microwave transceiver to measure the thickness of a coal deposit and to control the cut of a continuous mining machine operating in an underground mine.

An advantage of the present invention is that a sensor is provided for the navigation of a mining machine in an undulatating coal deposit.

Another advantage of the present invention is that a system is provided that can measure coal deposit thicknesses exceeding twelve inches.

An advantage of the present invention is that a system is provided that generates its own electrical power from the rotation of its electronics package during use.

A further advantage of the present invention is that a system is provided that increases the efficiency of an underground continuous mining machine operation.

Another advantage of the present invention is that a method is provided for leaving behind contaminated coal deposit layers that have excess levels of sulfur, ash, and heavy metals.

A further advantage of the present invention is that a system is provided for measuring uncut coal thickness and rib coal thickness.

Another advantage of the present invention is that the sensor can detect shale bands and cutting depth into floor shale.

These and other objects and advantages of the present invention will no doubt become obvious to those of ordinary skill in the art after having read the following detailed description of the preferred embodiment that is illustrated in the various drawing figures.

IN THE DRAWINGS

DETAILED DESCRIPTION OF THE PREFERRED EMBODIMENTS

Figure 1:
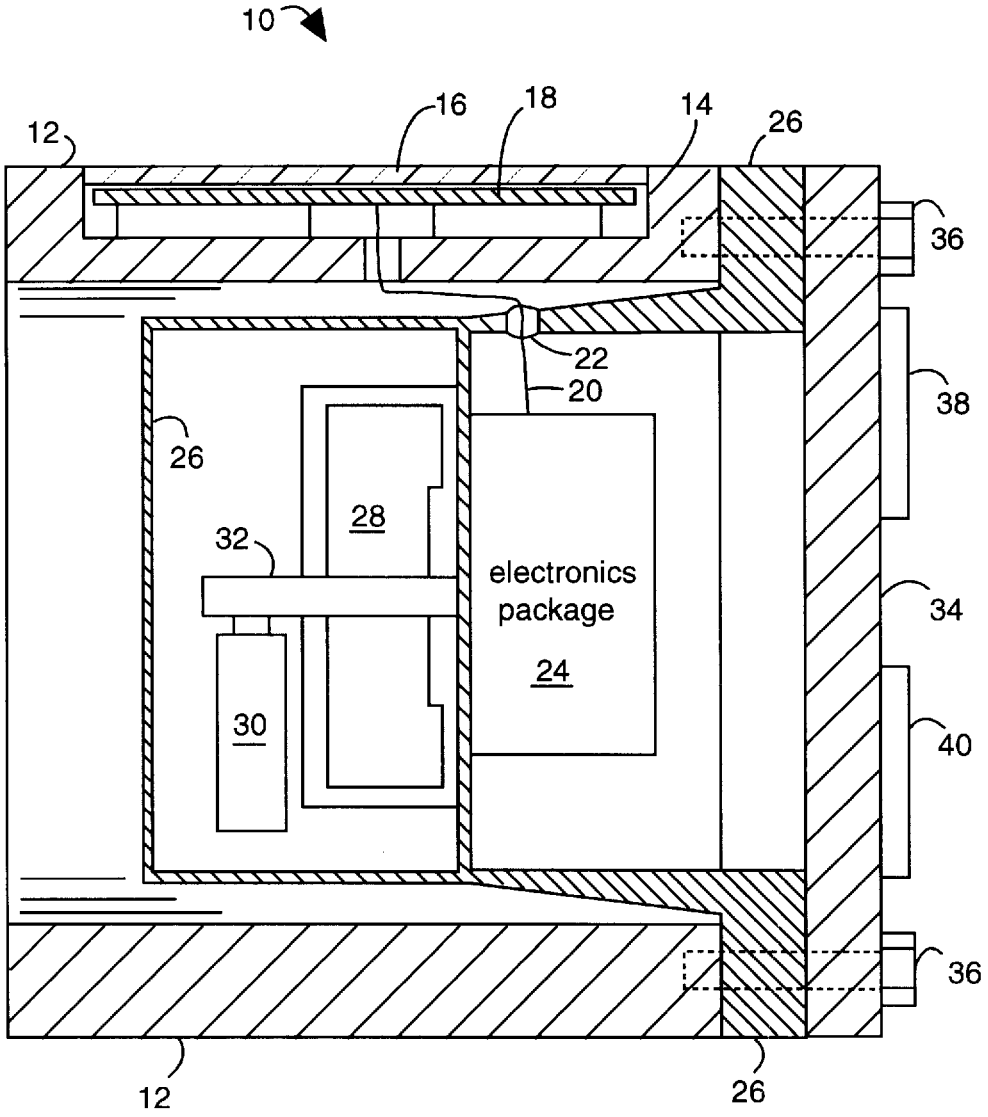
FIG. 1 is a cross-sectional diagram of a measurement system embodiment of the present invention mounted within the cutting drum of a mining machine.

FIG. 1 shows a measurement system embodiment of the present invention, referred to herein by the general reference numeral 10. The system 10 is mounted to a cutting drum 12 of a mining machine. Typicality, the cutting drum 12 will rotate on an axis parallel to the horizontal. The outside diameter of the cutting drum 12 includes bits to knock loose material such as coal, trina or potash in a mine. The system contained within 12 measures the thickness of such coal when in contact. A well 14 in the cutting drum 12 accepts a polycarbonate or ceramic cover 16 that protects a resonant microstrip patch antenna 18. A coaxial cable 20 connects to the antenna 18 and is passed through a gland or grommet 22 that keeps out an explosive atmosphere and that prevents ignition of the explosive atmosphere by an electronics package 24. An explosion proof housing 26 is inserted into an open end of the cutting drum 12 and provides and enclosure for the electronics package 24 and an AC alternator 28. A counterweight 30 constantly hangs toward nadir and provides a relative spin of an axle 32 within the AC alternator 28. Thus as the cutting drum 12 rotates during use, the AC alternator provides operational power to the electronics package 24. A cap 34 is held in place by a plurality of fasteners 36 and seals the explosion proof housing 26. A pair of right and left circular polarization antennas 38 and 40 are mounted on the outside of the cap 34 and connect to the electronics package 24.

Figure 2:
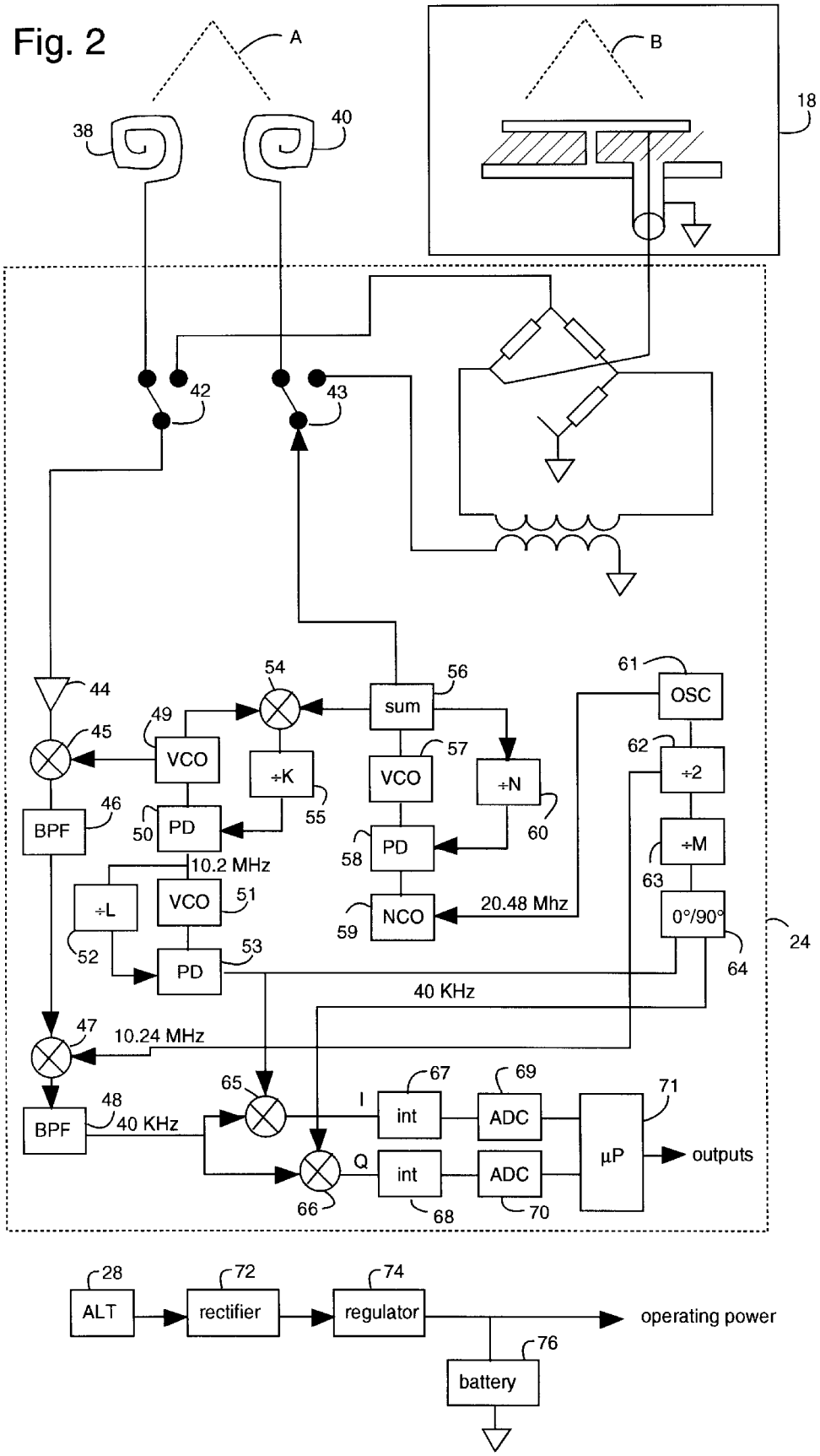
FIG. 2 is a block diagram of the electronics package and the antennas in FIG. 1.

FIG. 2 is a block diagram of the microprocessor-controlled electronics used in FIG. 1. A synthetic-pulse stepped-frequency ground-penetrating radar is used to measure the thicknesses of geologic layers of material, e.g., the coal seams and deposits of trona and potash. For more information on such radars, see, David A. Noon, et al., "Advances in the Development of Stepped Frequency Ground Penetrating Radar", GPR '94, vol. #1. For more information about resonant microstrip patch antennas, see U.S. Pat. No. 5,072,172.

Together, antennas 38 and 40 form a wideband microwave microstrip antenna assembly. The right-hand circularly polarized antenna 40 is used as a transmitting antenna and the left-hand circularly polarized antenna 38 is used as a receiving antenna. A signal A represents the transmission and reception of a radio signal through a layer of material. Alternatively, the transmitting antenna 40 is left-hand circularly polarized and the receiving antenna 38 is right-hand circularly polarized. It is critical that both antennas 38 and 40 be of opposite circular polarizations and that they be oriented side-by-side in the same plane, e.g. on the cap 34, to minimize cross-coupling.

The antennas 38 and 40 are positioned such that a reflected radio signal A is received by antenna 38 after being output by antenna 40, passing through a coal seam, for example, and being reflected at an air interface. The reflected signal is received by the antenna 38 and is shifted in phase by a mirror-effect. Since it is only the reflected signal that is of interest, the opposite polarization of the receiving antenna 38 will be especially sensitive to mirrored reflections. Direct crosstalk has no such polarization shift and will be rejected. The distance of travel of the reflected signal A, e.g., through the coal seam, affects both the amplitude and phase of the signal received by the antenna 38.

The resonant microstrip patch antenna 18 is positioned on the surface of the cutting drum 12, where a reflected signal B from the interface of coal seam and an overburden causes the radio signal to be reflected.

A pair of switches 42 and 43 provide for the selection between the antennas 38 and 40, and the resonant microstrip patch antenna 18.

The receiver section of electronics package 24 includes a radio frequency amplifier 44 connected to the antenna switch 42 and a mixer 45. A 10.20 MHz intermediate frequency (I/F) is amplified by an intermediate frequency stage and bandpass filter 46. A mixer 47 combines the I/F and a 10.24 MHz in-phase reference. A band pass filter 48 provides a filtered output. A voltage controlled oscillator (VCO) 49 provides a local oscillator frequency to convert the received reflected signal A from antenna 38 fed to the mixer 45 through switch 42. A phase detector (PD) 50 controls the VCO 49. A VCO 51 is connected to a divide-by-L counter 52 and a phase detector (PD) 53. Inputs from a divide-by-K counter 55 and a 10.2 MHz reference frequency from the VCO 51 are used to control the VCO 49. A reference signal is connected to the phase detector 53.

The transmitter section of electronics package 24 includes a linear summation network 56 connected to the switch 43. A phase lock loop operates in the 200 MHz to 1600 MHz range. A phase detector (PD) 58 controls the VCO 57 according to the phase difference between signals from a numeric controlled oscillator (NCO) 59 and a divide-by-N counter 60. A reference oscillator 61 provides a 20.48 MHz frequency for synchronization of the NCO 59. The reference oscillator 61 signal is divided in half by a counter 62 to 10.24 MHz and output as a signal to the intermediate frequency mixer 47. The 10.24 MHz signal is further divided by M with a divider 63 and phase split by a splitter 64 to provide a zero and ninety degree synchronized logic signal for an in-phase (I) mixer 65 and a quadrature phase (Q) mixer 66. A pair of integrators 67 and 68 are connected to a pair of I and Q analog-to-digital converters (ADCs) 69 and 70 for reading by a microprocessor 71. The operating frequency of NCO 59 is controlled by the microprocessor 71.

The alternator 28 provides an AC input that is converted to DC by a rectifier 72 and regulated in voltage by regulator 74. A battery 76 provides operational power during brief interruptions in power output by the alternator 28.

The horizontal thickness measurement and upper/lower thickness values are numerically determined in the microprocessor 71. The operating frequency of NCO 59 is effectively multiplied by the phase-locked-loop (PLL) which comprises the VCO 57, the linear summation network 56, the frequency divider network (N) 60, and the phase detector (PD) 58. The PLL network multiplies the frequency of the NCO 59, and the resulting signal is applied to the antennas 40 or 18. Preferably, the microprocessor 71 is used to encode the radiated signal. In the mining machine a second receiver can be used to decode the RF signal and apply the decoded signal information to an electro-hydraulic control for navigation.

The phase and amplitude of the processed reflected signal A or B is readable by the ADCs 69 and 70 and provide digitized received signal amplitude information to the microprocessor 71 for both the in-phase and quadrature phase. The phase change of the reflected signal A or B is determined by the relative amplitudes seen by ADCs 69 and 70 for each stepped-frequency. The amplitude of the received reflected signal A or B is the vector sum of the two amplitudes seen by ADCs 69 and 70 for each stepped-frequency. The microprocessor 71 controls the output of each frequency step from the transmitter. The frequency, phase and amplitude information in the received signals are then used to determine the coal seam thickness proximate to each antenna 38, 40 and 18.

A computer program included in the microprocessor 71 uses the amplitude and phase information to estimate the thickness of material through which the signal A or B was reflected, e.g., coal seams. The conversion data used to estimate the thickness of the coal seam from the amplitude and phase information can be empirically derived. Since the local oscillator signals used in both the transmitter and the receiver sections are phase coherent, the phase detected and read by the microprocessor 71 will be principally dependent on the path experienced by the reflected signal A and B. A simple display can be included in the microprocessor 71 to indicate to the operator of the mining machine the thickness of the coal seam.

The transmitter section is preferably operated to generate a sequence of continuous wave (CW) bursts in frequency steps across a band from 200 MHz to 1000 MHz. To simplify the radar, sixty-four to 128 equal frequency steps can be used. For the resonant microstrip patch antenna 18, the frequency is stepped until resonance is found. The microprocessor 71 determines the resonant impedance, or resistance, from a measurement from a bridge in antenna 18. For the stepped-frequency radar, each frequency-stepped burst produces a corresponding signal in the receiver section. The relative amplitudes of the received signals taken with the respective frequency of the burst suggest the distance traveled by the reflected radio signal A or B. The velocity of propagation is related to the phase constant of the material. A fast Fourier series is used to analyze and determine the distance the reflected signal A or B traveled.

The antenna 18 is typically mounted on the outside diameter of the cutting drum 12. The transmitter section sweeps the frequency in steps that are preferably complete within a 4°–5° arc of rotation of the cutting drum 12 at the top. The series of frequency steps can also be parsed over several occurrences of the antenna 18 being at the top 4°–5° of arc of the cutting drum 12. In such a case, the microprocessor 71 is connected to the cutting drum 12 to sense its angular position and it synchronizes the generation of the frequency-steps from the transmitter section to coincide with the rotation to the top of antenna assembly 18.

Figure 3:
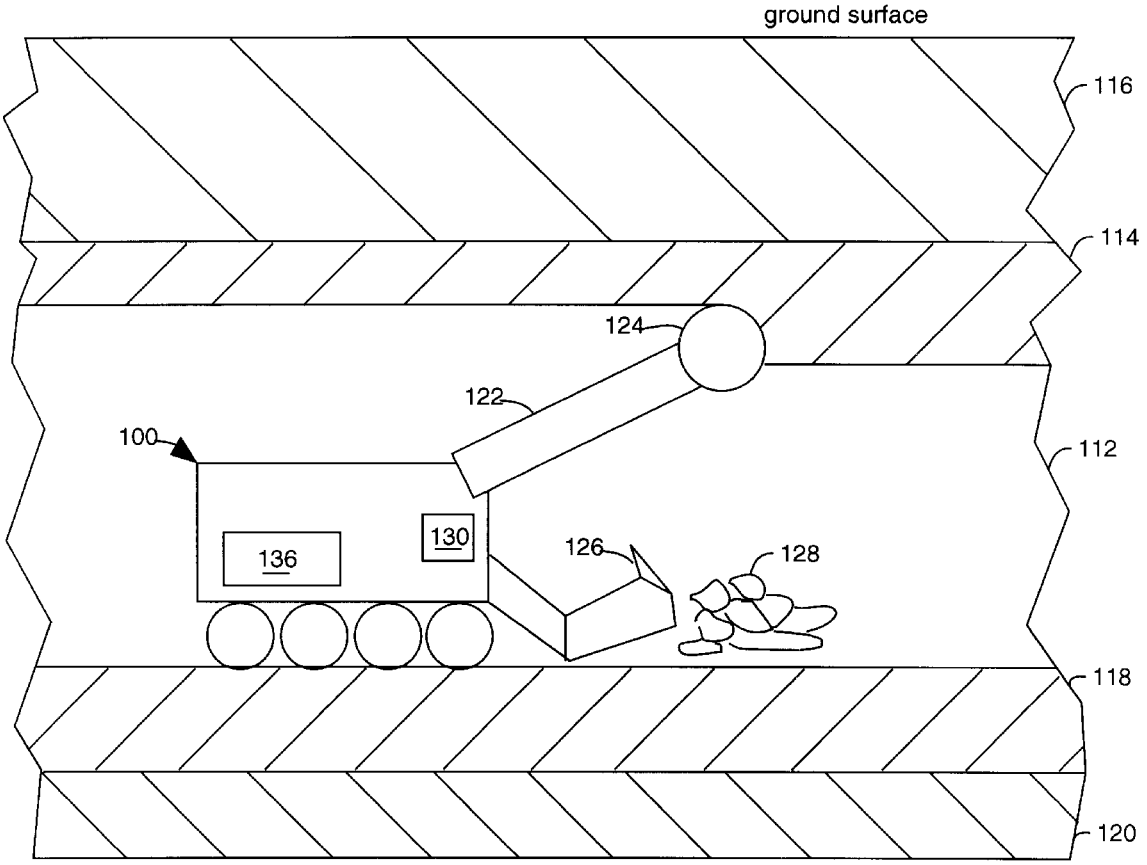
FIG. 3 is a cross-sectional diagram of an underground coal mine and a continuous mining machine in operation.

FIG. 3 illustrates a continuous operational mining machine 100 operating in an underground mine 112. An upper seam of coal 114 underlies an overburden or band 116, which can include oil shale, sandstone, mud and mud stone. A lower seam of coal 118 is at the floor of the mine 112 and is on top of a layer 120. The respective vertical thicknesses of the upper and lower coal seams 114 and 118 are variable over the horizontal travel of the machine 100. A boom 122 attached to the machine 100 supports a rotating cutting drum 124, which is similar to cutting drum 12. The boom 122 is adjusted to control the amount of coal seam 114 that is excavated by the cutting drum 124. To improve run-of-mine coal quality, the top and bottom twelve to twenty inches of a coal deposit are ordinarily left in place, because such layers have higher sulfur, ash, and heavy metal contamination. Typical cutting drums 124 are thirty to fifty inches in diameter and rotate about forty to sixty revolutions per minute. The continuous mining machine 100 is typically eight to fourteen feet wide. A longwall cutting machine can also use cutting drum 124 and can shuttle along the coal face at forty feet per minute. The coal face may be 400–1200 feet long. A gathering arm 126 scoops up a slump coal material 128 that falls to the floor of the mine 112. The loosened coal is carried out of the mine 112 by a conveyor belt.

When the boom 122 is in the upper-most position, the antenna 18 is used to measure the thickness of the coal layer 114. When the boom 122 is in the lower-most position, the antenna 18 is used to measure the lower coal layer 118. If a radio transmitter is connected to the microprocessor 71 outputs, a radio receiver 136 can provide the operator of the continuous mining machine 100 with an indication of the thicknesses of the coal seams above, below and at the sides of the mine 112, e.g., coal seams 114, and 118. Such radio signals are used to navigate the cutting machine in the coal seam.

Figure 4:
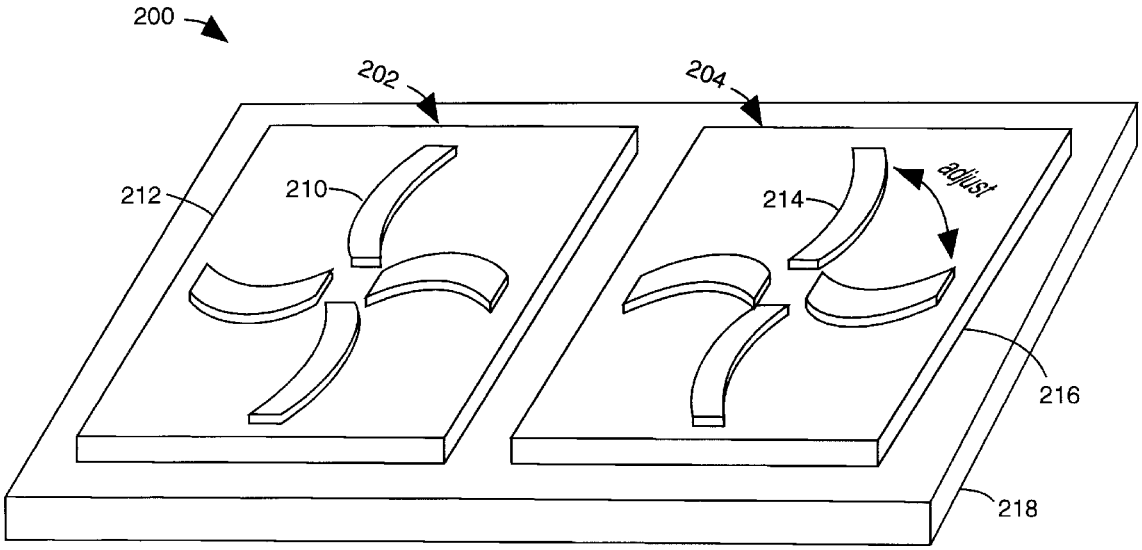
FIG. 4 is a diagram of circularly-polarized transmitting and receiving antennas used with the radar of FIG. 1.

FIG. 4 illustrates the antenna assembly 200. The transmitter antenna 202 comprises a right-hand circular-polarization-patterned microstrip conductor 210 on a ceramic substrate 212. The receiver antenna 204 comprises a left-hand circular-polarization-patterned microstrip conductor 214 on a ceramic substrate 216. The antenna 204 is similar to antenna 40 and the antenna 204 is similar to antenna 38. Both antennas 202 and 204 produce front and back lobes. The front lobes are directed toward the coal seam, or other deposit material layer, to be sensed. The back lobes are attenuated by an absorber material 218. The antennas 202 and 204 are in the same plane on the absorber material 218. Crosstalk is minimized by adjusting the relative orientation of the transmitting antenna 202 to the receiving antenna 204. For example, the receiving antenna can be adjusted by rotating it. In order to protect the antennas 202 and 204 from abrasion during use, they are preferably coated or overlaid by ceramic or polycarbonate, e.g., LEXAN.

Ideally, there will be one sharp reflection of the reflected signal A or B detected that corresponds to the interface of a coal seam with air. In practice, the detected reflections will conform in amplitude to a bell-shaped curve. A major first face reflection at the interface of the air between the antenna and the coal seam, for example, will also be detected.

Figure 5:
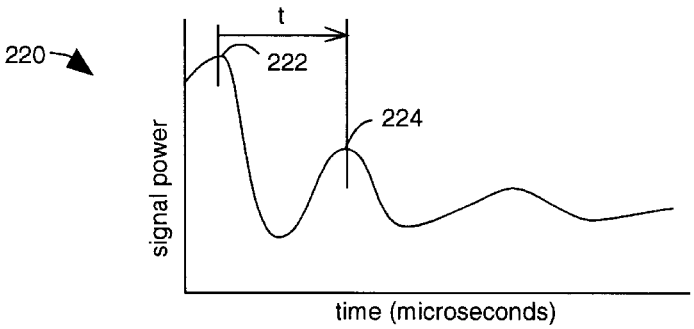
FIG. 5 is a graph of the response in the radar of FIG. 1 when in contact with a coal seam.

FIG. 5 illustrates a typical curve 220 generated by amplitude in the time domain. A peak 222 corresponds to the first interface between the air and the coal seam 14. A second, smaller peak 224 corresponds to the second interface between the coal seam 114 and the overburden 116. The peak 224 can be distinguished in the fast Fourier transform data extracted from ADCs 69 and 70. The reflection time difference between the peaks 222 and 224 represents velocity of the reflected signal A or B divided by the product of the thickness of the coal seam and the dielectric constant of the coal. Since the dielectric constant of coal, or any other material can be determined and fixed, the thickness of the coal seam can be automatically determined. The microprocessor 71 therefore includes computer-implemented means for determining the thickness of the coal seam, for example, from the time "t" between the peak 222 and the peak 224. The distance "d" that the reflected signal A or B travels is related as follows, $$d = \frac{C}{\sqrt{\in_1}}\, t,$$

where, c=the speed of light, and $e_1$ is the dielectric constant of the coal, typically $e_1$=6. Tests indicate that the peaks 222 and 224 are sufficiently separated to become individually identifiable when the coal seams measured are greater than twelve inches in thickness.

Figure 6:
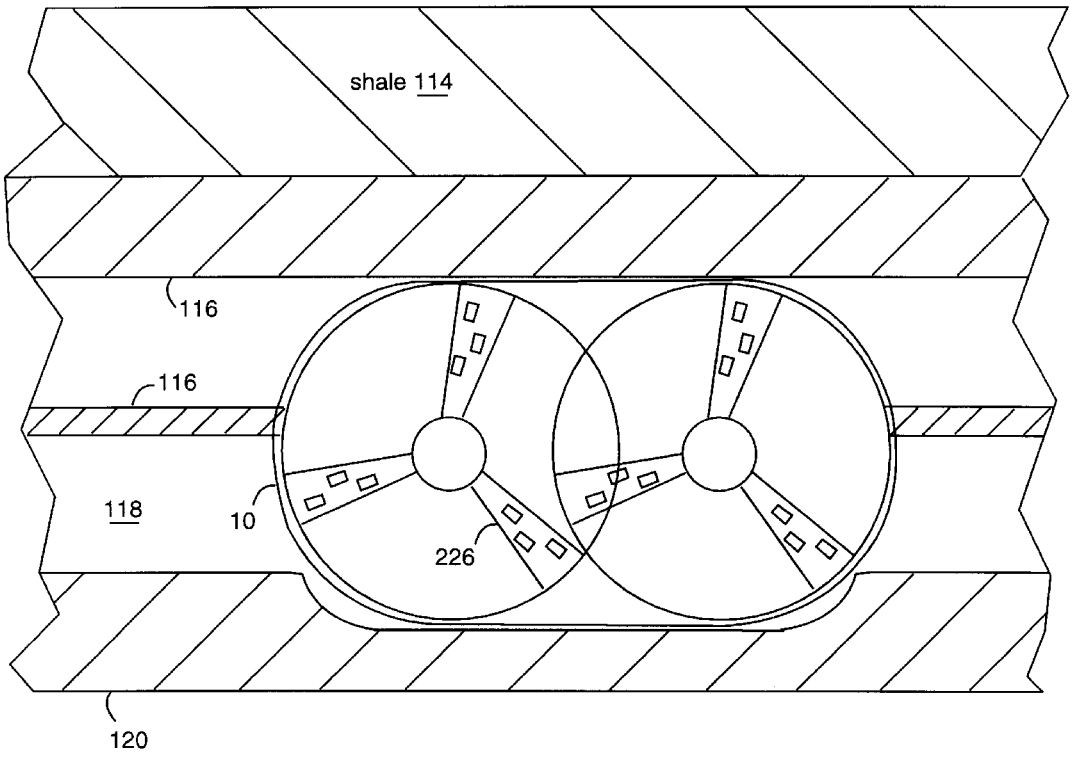
FIG. 6 is a diagram of the front view of a rotating arm continuous miner.

FIG. 6 illustrates the front view of a continuous mining machine with rotating arms 226. The receiving microstrip patch antenna (RMPA) 204 is mounted on the end of the arm. An explosion proof inclosure with its electrical generator and electronics is mounted on the backside of the arm. Since the angular position of the arm is known when RMPA 204 is near the shale band, the shale band location will be determined by the microcomputer 71.

Although the present invention has been described in terms of the presently preferred embodiments, it is to be understood that the disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

What is claimed is:

1. An underground mining system, comprising:

an underground mining machine with a repositionable excavating cutter;

an antenna assembly attached to the underground mining machine and including a planar circularly-polarized transmitter antenna and a planar circularly-polarized receiver antenna mounted side-by-side in a common plane and of opposite circular polarizations;

a transmitter connected to said transmitter antenna with means for emitting synthetic pulse frequency-stepped ground-penetrating radar signals over a range of frequencies into materials accessible to said repositionable excavating cutter;

a receiver connected to said receiver antenna with means for measuring the amplitude and phase of received signals affected by said materials accessible to said repositionable excavating cutter; and estimation means connected to the receiver for interpreting said amplitude and phase of said received signals into estimates of the thickness of an underground layer of geologic material accessible to said repositionable excavating cutter and proximate to the antenna assembly, wherein said estimates are based on predetermined dielectric constants of said underground material layer.

2. The system of claim 1, wherein:

the antenna assembly includes a microstrip antenna mounted on a surface of said repositionable excavating cutter; and the estimation means determines a vertical thickness of a horizontal overhead seam comprising at least one layer of coal, trona and potash.

3. The system of claim 2, further comprising:

a controller connected to servo-control said repositionable excavating cutter according to an output of the estimation means and that provides for cutting away all but a minimum predetermined vertical thickness of said horizontal overhead seam.

4. The system of claim 1, wherein:

said repositionable excavating cutter comprises a rotating cutting drum in which the antenna assembly is mounted on the surface; and the estimation means determines a thickness of a material seam layer comprising at least one of coal, trona and potash.

5. The system of claim 4, further comprising:

a controller connected to servo-control said repositionable excavating cutter according to an output of the estimation means and that provides for cutting away all but a minimum predetermined thickness of said material seam layer.

6. The system of claim 1, wherein:

the antenna assembly is mounted to a side of said repositionable excavating cutter and provides for the shaping of a set of vertical ribs of material to support a ceiling of an underground mine; and the estimation means provides measurements of the horizontal thickness of said vertical ribs of material based on signals received from the antenna assembly.

7. The system of claim 6, further comprising:

a controller connected to use said measurements from the estimation means to horizontally adjust said repositionable excavating cutter automatically for cutting away all but a minimum predetermined horizontal thickness of said vertical ribs.

8. The system of claim 1, wherein:

the receiver is configured to be phase coherent with the transmitter, and at least sixty-four equally spaced frequency steps are generated by the transmitter over a range of frequencies which includes 200 MHz to 1000 MHz.

9. The system of claim 1, wherein:

an electronics assembly that includes the transmitter, receiver, and estimation means is mounted in a rotating cutting drum of said repositionable excavating cutter; and the estimation means determines the corresponding respective vertical thickness of a proximate coal, trona, or potash seam that is variable over a horizontal travel of the underground mining machine.

10. The system of claim 9, further comprising:

a timer connected to said rotating cutting drum and the transmitter for controlling the transmitter to time the generation of said frequency-steps to coincide with the antenna assembly being rotated to a top 4°–5° of an arc of rotation of said rotating cutting drum.

11. The system of claim 9, further comprising:

a material cover of ceramic or polycarbonate is placed over the antenna assembly for wear protection.

12. A method for determining the thickness of underground geologic deposits over twelve inches in thickness, the method comprising the steps of:

transmitting a series of synthetic-pulse stepped-frequency ground-penetrating radar signals from a circularly polarized microwave microstrip transmitting antenna into an underground geologic deposit;

receiving a reflected series of signals with a second microwave microstrip receiving antenna having a circular polarization opposite to said transmitting antenna;

using a fast Fourier transform to generate amplitude versus time data;

signal processing said data to determine a time "t" between a first amplitude peak corresponding to a near interface of said underground geologic deposit and a second amplitude peak corresponding to a far interface of said underground geologic deposit, where "t" is the travel time of said transmitted signals reflected through the thickness of said underground geologic deposit; and estimating the dimension of said thickness of said underground geologic deposit by multiplying the speed of light by the time "t" and dividing the product by the square root of a predetermined dielectric constant of the material of said underground geologic deposit.

13. The method of claim 12, wherein:

the steps of transmitting and receiving are such that said transmitting and receiving antennas are mounted to a continuous mining machine.

14. The method of claim 13, further comprising the step of:

controlling the cutting depth of said continuous mining machine into said underground geologic deposit according to an estimate of said thickness of said underground geologic deposit obtained in the step of estimating.

15. A instrumentation system for determining the thickness of underground geologic deposits from a cutting drum of a mining machine operating in explosive atmospheres, the system comprising:

a power generator providing for the ignition-free generation of electrical power in an explosive atmosphere from an alternating current (AC) alternator mechanically driven by at least one of a water turbine and a swinging counterweight set in motion by a rotating cutting drum of a mining machine:

an antenna assembly including a planar circularly-polarized transmitter antenna and a planar circularly-polarized receiver antenna mounted side-by-side in a common plane and of opposite circular polarizations and mounted near an outer perimeter of said rotating cutting drum and mounted behind a protective skin;

a transmitter connected to said transmitter antenna and providing for synthetic pulse frequency-stepped ground-penetrating radar signals over a range of frequencies, and connected to receive operating power from the power generator;

a receiver connected to said receiver antenna and providing for measurements of a radio-illuminated underground material layer based on the amplitude and phase of received signals, and connected to receive operating power from the power generator; and estimation means connected to the receiver for interpreting said amplitude and phase of said received signals into estimates of the thickness of an underground layer of geologic material proximate to the antenna assembly based on predetermined dielectric constants of said underground material layer, and connected to receive operating power from the power generator.

16. The system of claim 15, wherein:

the antenna assembly further comprises a combination of stepped-frequency and resonant patch antennas as sensors that are disposed in said cutting drum and provide navigation signals for the mining machine according to an estimate of said radio-illuminated underground material layer thickness provided by the estimation means.

* * * * *